United States Patent [19]

Turner

[11] 4,215,523

[45] Aug. 5, 1980

[54] PACKING MACHINE

[76] Inventor: Arthur G. Turner, 27 York St., Norwich NR2 2 AN, England

[21] Appl. No.: 5,395

[22] Filed: Jan. 22, 1979

[30] Foreign Application Priority Data

Jan. 24, 1978 [GB] United Kingdom ..... 2852/78

[51] Int. Cl.[3] ..... B65B 57/10; B65B 5/10

[52] U.S. Cl. ..... 53/496; 53/538; 53/244; 53/260

[58] Field of Search ..... 53/496, 538, 244, 260

[56] References Cited

U.S. PATENT DOCUMENTS

| | | | |
|---|---|---|---|
| 2,661,882 | 12/1953 | Francisco | 53/538 X |
| 2,909,016 | 10/1959 | Sherrill | 53/496 |
| 3,673,756 | 7/1972 | Prete et al. | 53/496 |
| 3,846,959 | 11/1974 | Good | 53/496 |

*Primary Examiner*—Travis S. McGehee
*Attorney, Agent, or Firm*—Henry R. Lerner

[57] ABSTRACT

A machine for packing objects into boxes comprises a platform comprising two horizontal flaps 15 on which an array of objects 11 to be dropped vertically into a box to form a layer therein is built up. When a complete array is sensed, a plunger 34 moves down to a position above or in contact with the array whereupon the flaps move first down to impart a vertically downward movement to the array and then flip quickly to a vertical position allowing the objects to fall past in their array with the plunger 34 maintaining position.

The operation of the flaps and the plunger is controlled by a rotating cam that drives a con-rod connected to the plunger.

15 Claims, 9 Drawing Figures

PACKING MACHINE

This invention relates to machines for packing a plurality of objects in boxes in a plurality of vertical layers.

Machines so far developed for this have been designed either to push objects horizontally into a box that is positioned on its side or to push object up into an inverted box, in both of which cases, the box has to be turned onto its base before ejection from the machine. These known machines have suffered from problems because of disorientation of the objects as they are moved into the box.

According to the present invention there is provided a packing machine for objects comprising a pair of removable pivoted flaps that, in one position in use, define a horizontal platform, means for forming on the platform a horizontal array of the objects, a vertically movable plunger which includes a member having a horizontal surface that is operatively associated, in use, with the upper surface of the array objects, means for sensing the formation of a complete array of objects on the platform and thereupon initiating downward movement of the plunger and of the flaps, the flaps being so arranged that they initially move vertically downward without any substantial amount of pivoting so as to allow the array of objects to move downward in its horizontal array, and subsequently pivot into a substantially vertical position allowing the array to move past them, the plunger being arranged so that during the movement of the flaps the said horizontal surface moves down close to, or in contact with, the upper surface of the horizontal array.

Preferably the machine includes means whereby the depth of downward movement of the said horizontal surface is varied each time over a series of operations by an amount equal to the vertical dimension of one of the objects so that the downward movement of the horizontal surface is adjusted as each layer of objects is built-up in a box.

The invention has particular advantage if the objects to be packed are cylindrical, since the difficulty of packing is great because of their tendancy to roll.

The invention will now be described by way of example with reference to the accompanying drawings, in which.

Figure 2:
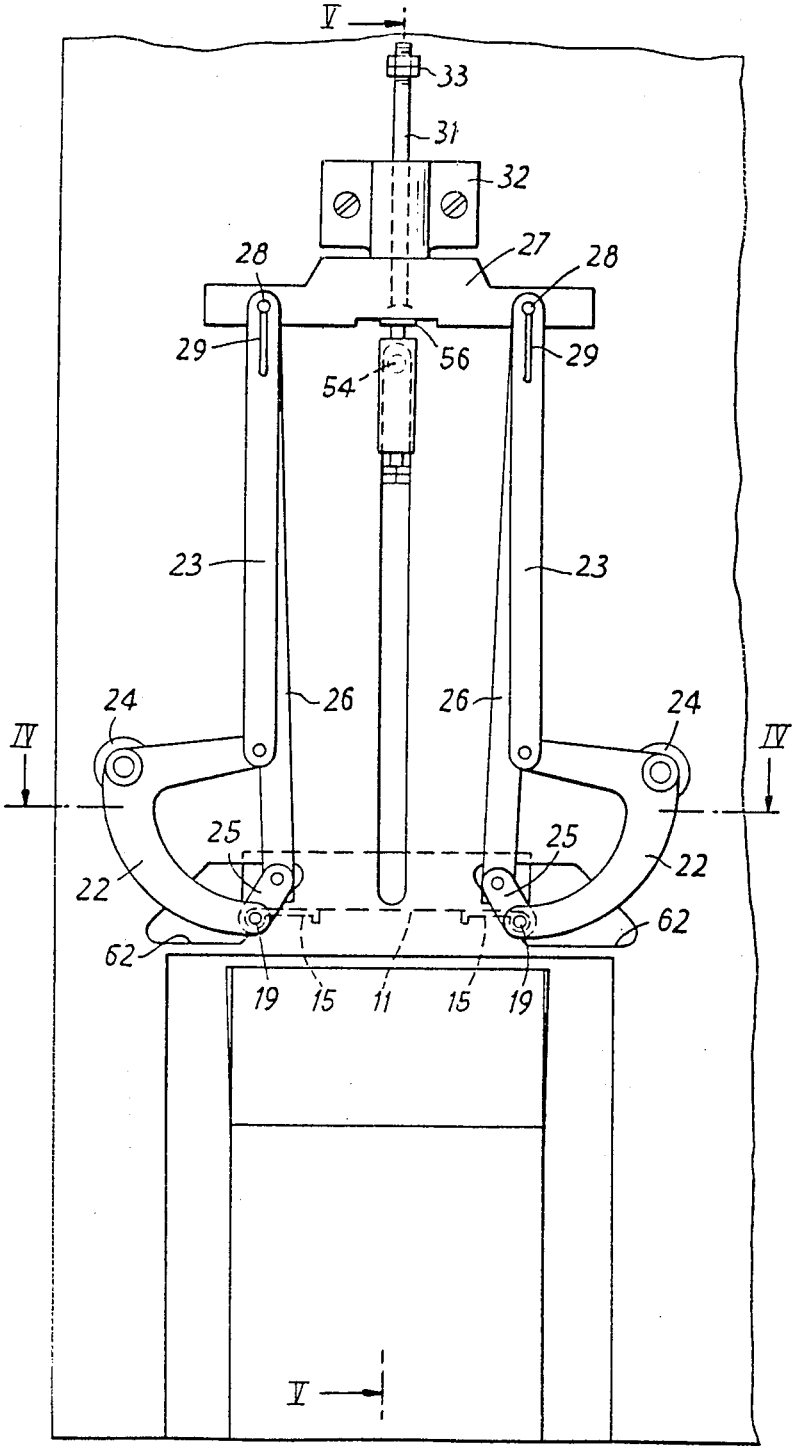
FIG. 2 is an end elevation of the apparatus shown in FIG. 1.
Figure 3:
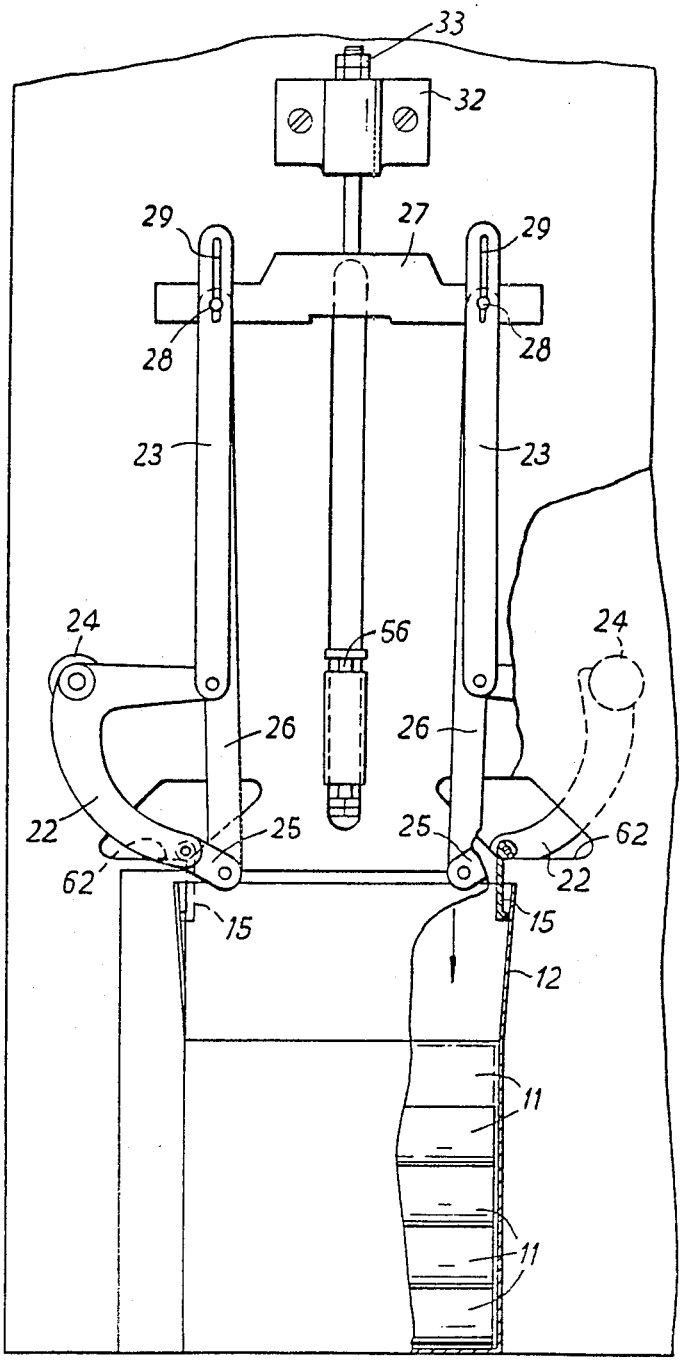
FIG. 3 is the same end elevation as is shown in FIG. 2, but at a different stage of the operating cycle.
Figure 4:
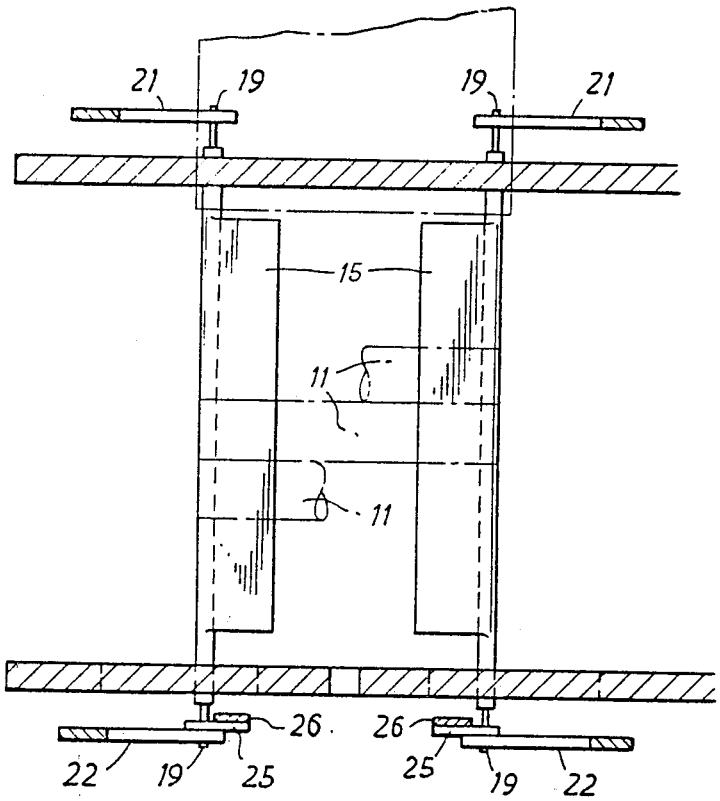
FIG. 4 is a horizontal section taken on the line IV—IV in FIG. 2.
Figure 5:
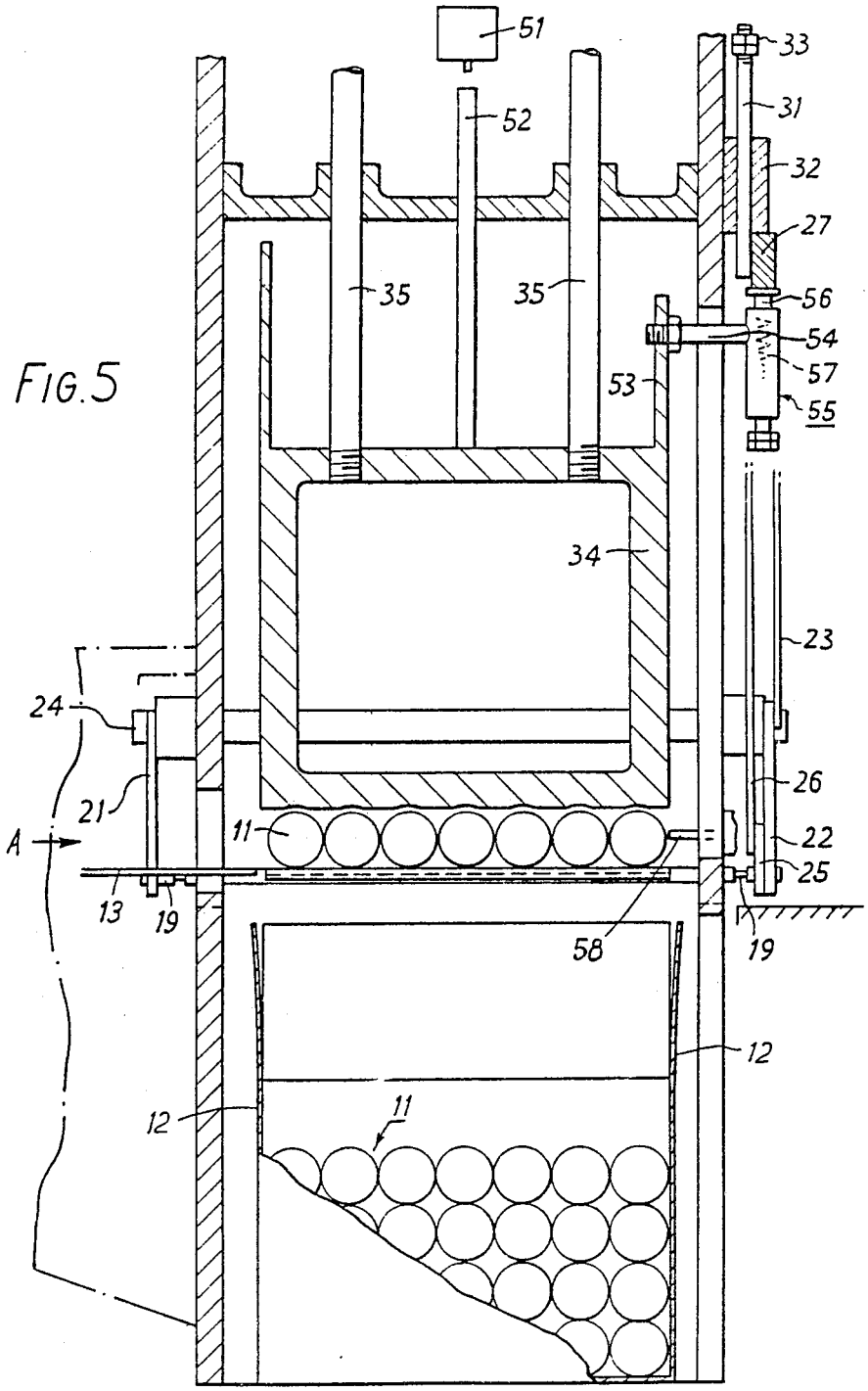
FIG. 5 is a vertical section taken on the line V—V in FIG. 2.
Figure 6:
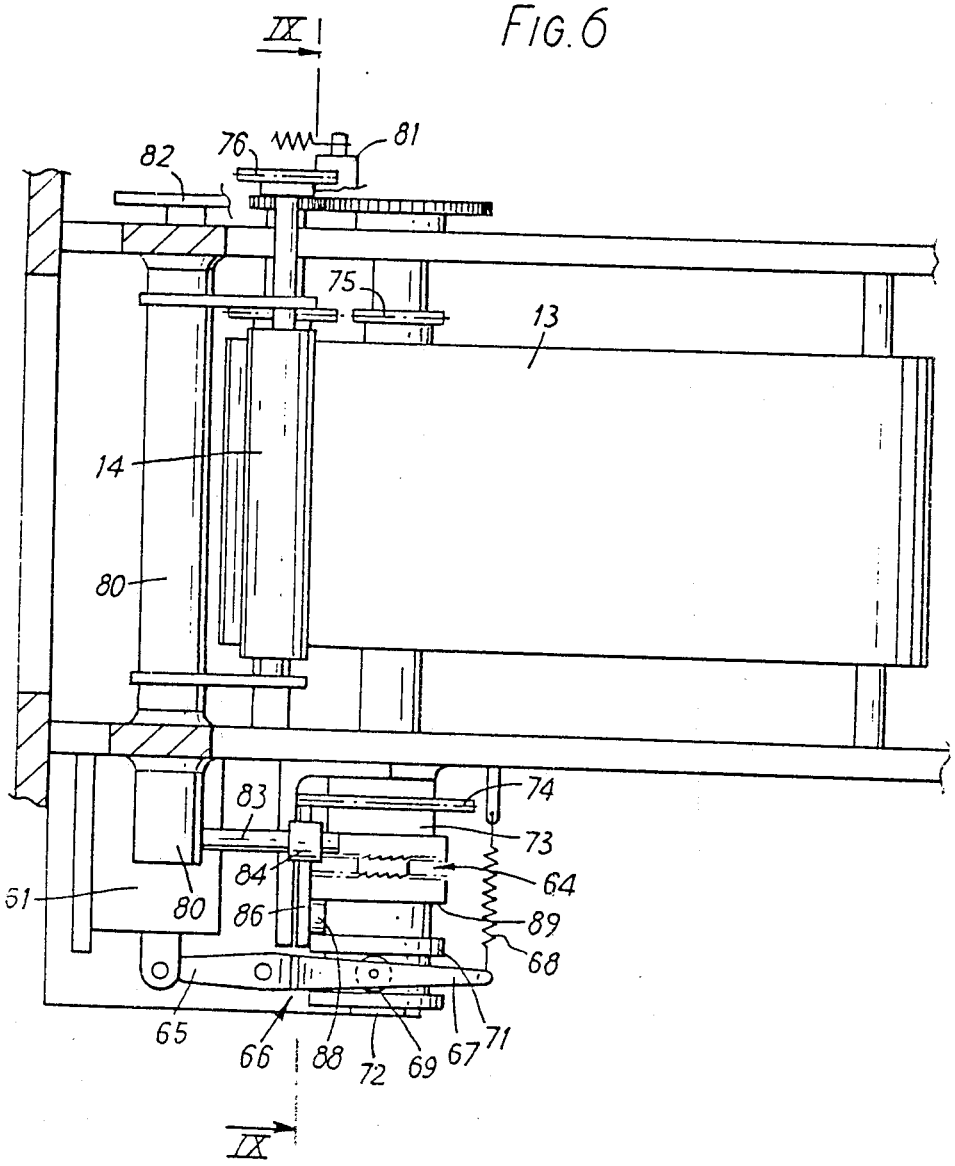
FIG. 6 is a plan view of the object-feeding arrangement of the machine.
Figure 7:
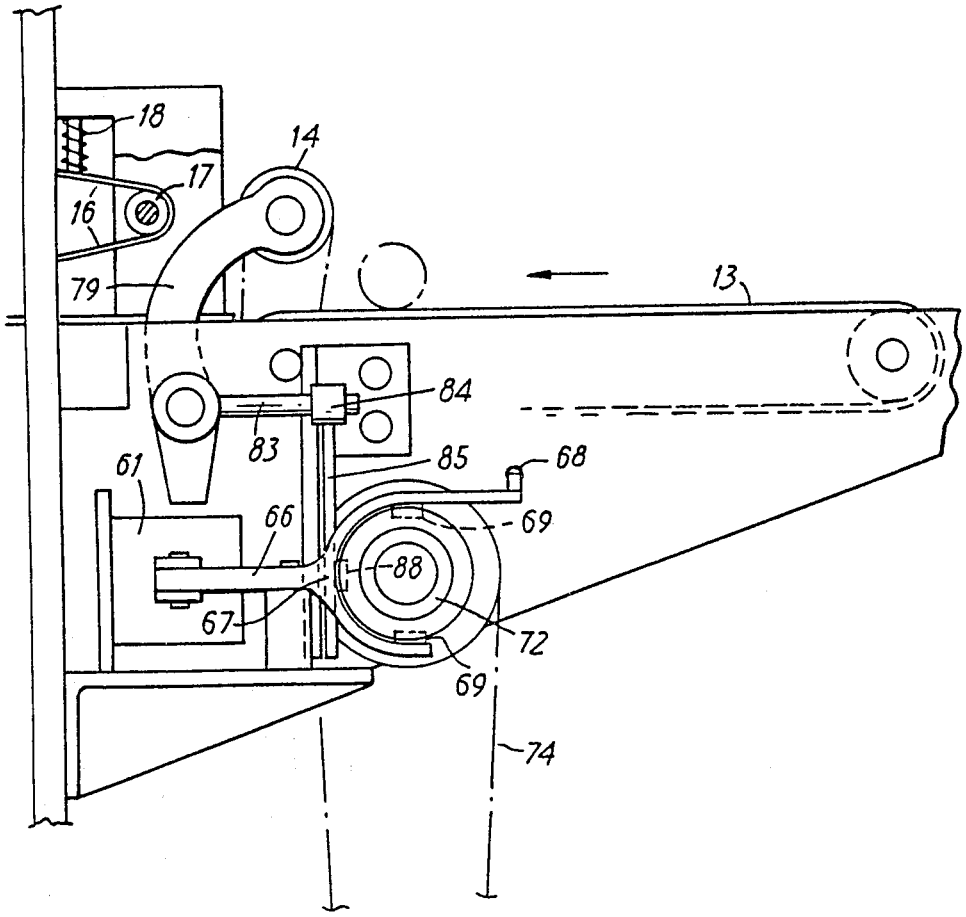
FIG. 7 is a side view of that arrangement.
Figure 8:
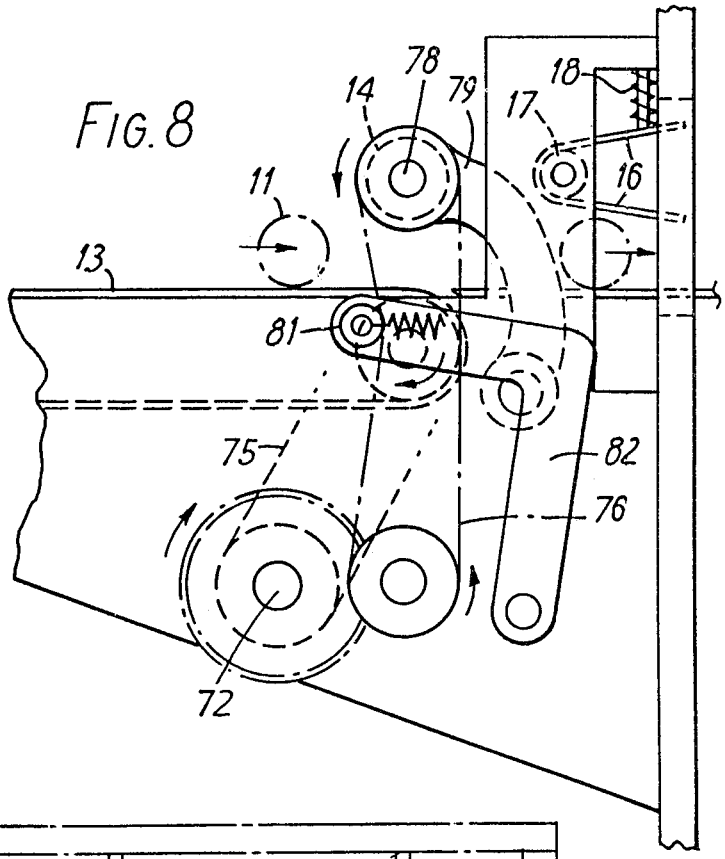
FIG. 8 is a schematic view of the arrangement taken from the other side.
Figure 9:
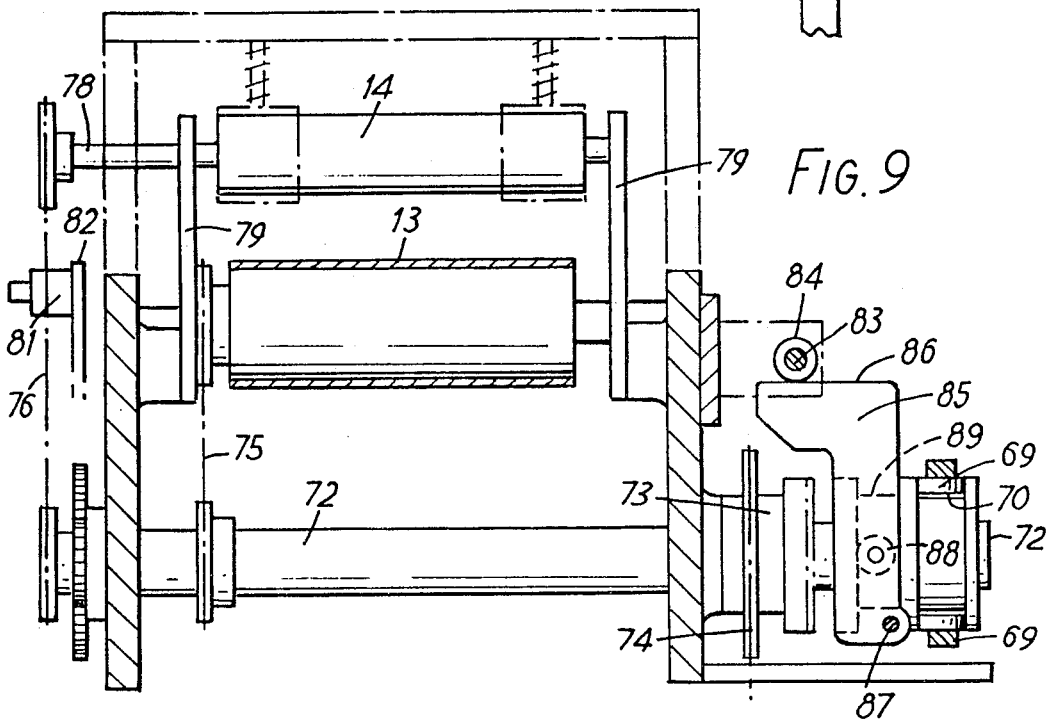
FIG. 9 is a vertical section on the line IX—IX in FIG. 6.

Cylindrical objects 11 to be packed in vertical layers in a cardboard box 12 are continuously delivered, one by one, in a direction (Arrow A in FIG. 1) at right-angles to their axis, by a belt conveyor 13 and a driven pressure roller 14 onto a platform comprising two pivoted flaps 15 that support the ends of the objects 11. Between the flaps 15 and the roller 14 are a pair of sprung fingers 16 that locate the object 11 that have passed the roller 14 and prevents them pushing on the objects 11 on the flaps 15 after a complete layer of objects 11 has built up on the flaps 15. The fingers 16 are U-shaped and are mounted at their vertex for pivotal move about a horizontal arm 17. The outer end of the lower arm of each finger 16 presses down on the foremost object 11 while the outer end of the upper arm is biased downwardly by a vertical spring 18 mounted on the frame of the machine, which biasing tends to rotate the finger 16 about the arm 17 and thus causes the lower arm of the finger 16 to bear down on the formost object 11. The flaps 15 are pivotally connected at their ends to movable linkages that support them and enable them to move between an object-supporting position, shown in FIG. 2 and an object-dropped position, shown in FIG. 3. As seen in FIGS. 2, 3 and 5 the flaps 15 are rectangular and are so mounted that in their object-supporting position they are substantially horizontal and spaced apart.

Each flap 15 is fixed along its outer, longer side to a shaft 19 which is pivoted at its ends to the lower ends of a respective one of a pair of vertically disposed front and rear arcuate connectors 21 and 22. The rear connectors 22, which are located outside a face plate of the frame of the machine, have two limbs substantially at right-angles, the lower one being pivoted, as above mentioned, at its free end to the shaft 19 and the upper limb being pivoted at its free end to a vertically extending link 23. At about its mid-point, each rear connector 22 is connected to one end of a horizontally extending pivot rod 24, the other end of which is pivotally connected to the upper end of the front arcuate connector 21. At the rear end, each shaft 19 is also fixedly connected to one end of a small connector 25, to the other end of which is pivotally connected a vertically extending link 26. The distance between the pivot point of the rear connector 22 and the rod 24 and the pivot point of the rear connector 22 and the vertically extending link 19 is approximately one third greater than the distance between the pivot point of the rear connector 22 and the rod 24 and the pivot point of the rear connector 22 and the vertical link 26.

The links 23 and 26 are pivotally connected to the rear and front sides respectively of a cross-support member 27, the former by means of pins 28 on the cross-support member 27 that engage in slots 29 in the upper ends of the links 23 and the latter by pivot pins (not shown). Extending upwardly from the cross-support member 27 is a vertical rod 31 that is slideably movable through a bracket 32 secured to the rear of the machine. A stop 33 on the upper end portion of the rod 31 limits the downward machine of the rod 31, and hence of the cross-support member 27 by engagement with the bracket 32.

Mounted above the flaps 15 is a hollow, rectangular plunger or former block 34, which has a profiled lower horizontal surface, comprising a parallel array of semi-cylindrical depression to aid correct location of the objects 11. The former block 34 is mounted for vertical movement on the lower ends of two rods 35 which are pivoted at their upper ends by intermediate links 36 to the arms of a yoke 37. The foot of the yoke 37 is pivoted to the frame of the machine whereby the yoke 37 is movable in a vertical plane by means of a con rod 38 that is connected to one end of a cam arm 39. The cam arm 39 is pivoted near its other end about a horizontal axis to the frame of the machine. A cam follower 41 is carried by the cam arm 39 and extends laterally therefrom to co-operate with a cam 42, which is fixedly mounted on a shaft 43. The cam 42 comprises a disc, the annular surface of which is formed with a series of depressions of various depths.

A spring loaded plunger 44 extends downwardly from the end of the cam arm 39 which is attached to the con rod 38 and co-operates with a series of stops 45 mounted on a disc 46 which is mounted on a shaft (not shown) and indexes in register with the cam 42 to which it is connected by a drive chain 47. The shaft 43 is driven by a motor (not shown) which is connected by a chain (not shown) to the driven part of a clutch drive plate 48, which has ratchet teeth 49 around its periphery. A pawl 51 engages with the ratchet teeth 49 and is movable to engage and disengage with the teeth 49 by means of a solenoid 52. The shaft 43 is normally driven in rotation in the direction indicated by the arrow B in FIG. 1, via the clutch drive plate 48, but the clutch disengages when the pawl 51 is engaged with the teeth 49.

The former block 34 is operatively connected to the flap linkages to cause operation thereof, the connection being via a lost motion arrangement: a vertically extending flange 53 of the former block 34 is connected by a horizontal nut-and-bolt connection 54 to a lost motion arrangement 55 that comprises a plunger 56, on which the cross-support member 27 rests, and a pressure spring 57.

The machine includes means for inserting an empty box 12 below the flaps 15 and for removing the box 12 after it has been filled. These means are of conventional design and will not be further described.

Turning now to the operation of the machine, an empty box 12 is positioned below the flaps 15 and objects 11 are fed, one by one, by the conveyor 13 and the roller 14 onto the flaps 15 where they rest with their two ends supported by the two flaps. When a complete layer of objects is arranged on the flaps, the foremost depresses a microswitch 58 initiating the operation of the flap operating mechanism: the solenoid 52 is energised, withdrawing the pawl 51. The microswitch 58 is also arranged, when operated, to energise a solenoid 61 which lifts the roller 14 and stops the conveyor 13 halting the feed of objects 11 onto the flaps 15, so that no further feeding takes place during the "dropping" part of the cycle.

Figure 1:
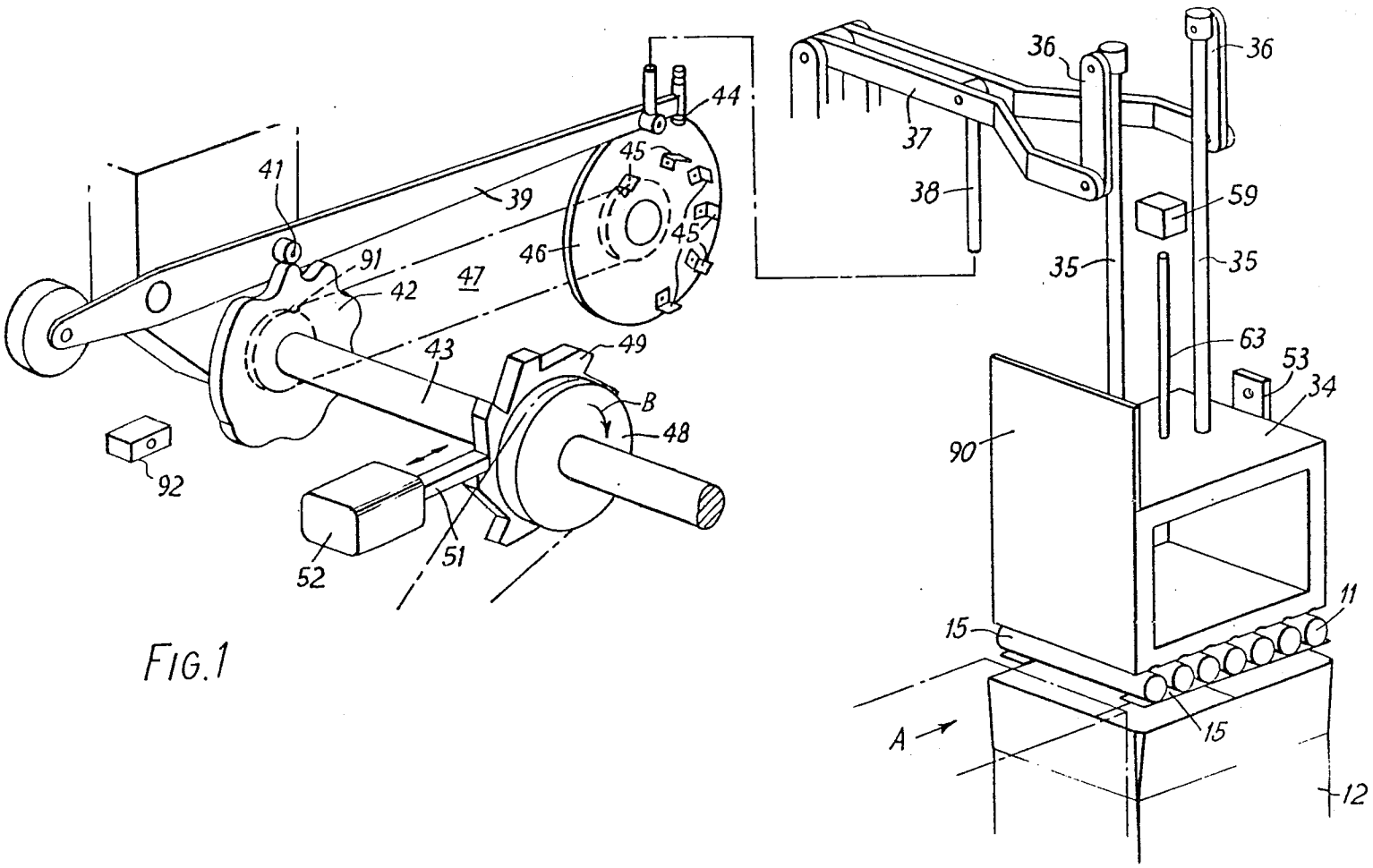
FIG. 1 shows schematically and in perspective parts of an apparatus embodying the present invention.

As the shaft 43 rotates from the position shown in FIG. 1, the cam follower 41 falls into the next trough of the cam 42 allowing the free end of the cam arm 39 to fall, pulling down the rod 38 and hence the yoke 37 the rods 35 and the former 34. The impact of the cam follower 41 on the cam 42 is cushioned by the plunger 44 which falls to contact a respective one of the stops 45, each of which is positioned at a distance from the axis of the disc 46 corresponding to the depth of the corresponding trough of the cam 42. During the initital downward movement of the former 34, no movement is imparted to the flap linkage, because the initial movement is taken up in the lost motion arrangement 55, the spring 57 raising the plunger 56 and maintaining the cross-support member 27 stationary. During the initial movement, however, the former 34 is moved downwardly to a position in which its lower surface is closely adjacent the upper surface of the layer of objects 11 on the flaps 15. After the initial movement, the connection 54 provides downward drive to the plunger 56 allowing the flap linkage to fall. Initially the entire linkage i.e. cross-support member 27 and links 23 and 26, falls and the flaps 15 and array of objects 11 supported on them move vertically downward with substantially no pivoting of the flaps 15. After a small amount of such movement the shafts 19 make contact with a stop face 62 constituted by the lower margin of a "window" in the front face of the frame of the machine through which the shafts 19 pass, thus preventing further bodily downward movement of the shafts 19 and the links 23 support member. The cross-support member 27 continues to fall and the pins 28 fall through the slots 29, because the shafts 19 are held against further downward movement, at the same time the links 26, which continue to move down, provide a turning force, via the small connectors 25, which causes a fast downward pivotting of the flaps to place the flaps 15 in a final vertical orientation. The bottom edges of the flaps come to rest just inside the box 12 (see FIG. 3), holding the flaps thereof open and forming a guide to ensue the objects 11 a clear passage into the box 12. The engagement of the stop 33 with the bracket 32 prevents further downward movement of the cross-member and the flaps and linkage, but the former block 34 continues to move downwardly closely above, or in contact with, the horizontal array of objects. The depth of the downward movement of the former block 34 is controlled by the profile of the cam 42, which is so arranged that for each successive operation of the machine during the filling of a box, the former block 34 moves downwardly by a distance smaller than it did on the previous operation and by an amount equal to the depth of one layer of the objects 11.

As the shaft 43 continues to turn, the cam 42 lifts the former block 34 until a microswitch 59 carried by the frame of the machine is operated by a pin 63 extending upwardly from the former block 34. Operation of the microswitch 59 causes a clutch 64 controlled by the solenoid 61 to engage causing the conveyor 13 and pressure roller 14 to recommence operation and begin feeding the objects 11 onto the flaps 15.

FIGS. 6 to 9 show the arrangement for interrupting the drive to the roller 14 and conveyor 13 while the flaps 15 are dropping and opening. The solenoid 61 acts on an end 65 of an arm 66 pivoted to the frame of the machine and normally biased by a spring 68 in a direction that moves the end 65 away from the solenoid 61. The other end of the arm 66 carries a yoke 67 with rollers 69 which engage in a peripheral groove 70 in a cylindrical member 71 which is slideably mounted on and is keyed to a shaft 72. The cylindrical member 71 carries one half of the clutch 64, the other half of which is provided on a second cylindrical member 73. The member 73 has a sprocket (not shown) which is driven continuously by a chain 74. When the clutch 64 is engaged, the drive from the chain 74 is transmitted by the first cylindrical member 71 to the shaft 72. The shaft 72 drives the conveyor 13 by means of a chain drive 75 and also drives a sprocket 77 which, via a chain drive 76, drives a shaft 78 on which the roller 14 is mounted. The shaft 78 and roller 14 are mounted between the upper ends of a pair of curved arms 79, which are pivotally mounted at their lower ends on a shaft 80. The drive chain 76 is maintained in driving tension by means of a roller 81 carried by the end of a spring-loaded, pivoted arm 82, which also serves to pull the roller 14 down on the objects 11. The roller 14 is lifted away from the objects 11 during the dropping of the flaps 15 by a linkage operated by movement of the cylindrical member 71 of the clutch 64. Connected to the end of the shaft 80 at a position beyond the curved arm 79, which is remote from to the drive 76, is an arm 83 which has at its end a roller 84. The roller 84 rests on an L-shaped, lifting finger 85 which is mounted substantially vertically, with the foot 86 of the L uppermost. The finger 85 is pivoted at its lower end to the frame of the machine about a horizontal axis 87. Extending horizontally from one face of the finger 85 is a roller 88 that engages in a groove 89 in the movable cylindrical member 71. As the member 71 is moved outwardly, the roller 88 engaging in the groove 89 causes the finger 85 to pivot, lifting the roller 84 and hence applying a rotational lifting movement to the curved arm 79.

It will be appreciated that the microswitches 49 and 59 remain closed during the feeding operation, but open as the flaps 13 and the former block 34 move down, thus halting the conveyor 13 and roller 14 during this phase of the machine's operation. Thus during the dropping of the flaps no further objects will be fed forward and the foremost objects in line will be retained by the fingers 16. Should any objects for some reason travel past the fingers during the dropping, they will be prevented from travelling forward into a position in which they could foul the operation of the machine by a vertically extending flange 90 on the front of the former block 34.

The profile of the cam 42 (see FIG. 6) has six high points at each of which the cam arm 39 is lifted so that the pin 63 operates the microswitch 59 to start the feeding of objects onto the flaps 15. The profile also has five major low points at each of which one layer of objects is without delay dropped into a box. A final major low point allows the bottom layer of each box to be dropped after a delay as described below. As the top layer is dropped into the box, the sixth and final high point is reached and the feeding onto the flaps 15 of the objects that will form the bottom layer in the next box starts. When this array is complete, the microswitch 58 is operated and the cam follower 41 starts its next fall. However, as seen in FIG. 1, only a very small fall to a minor low point is permitted by the shape of the cam face. This fall is just sufficient to operate the switch 59 and prevent further objects being fed onto the flaps, but not sufficient to produce any significant opening of the flaps 15.

The cam 42 has a dwell-section immediately following the sixth high point and the minor low point, which dwell-section corresponds to the operation of ejecting a full box 12 and inserting a new, empty box 12. At the end of the dwell-section on the outside face of the cam is a pressure piece 91 which, when brought into contact with a microswitch 92 carried by the frame, energises the solenoid 52 withdrawing the pawl 51 so that the cam 42 turns and the cam follower makes its fall into the final major low point to drop the bottom layer of object into the box. A delay line (not shown) in the electrical circuitry of the machine provides about 1/20 sec. delay between operation of the switch 92 and restarting of the feeding of the objections 11, which delay gives time for the former block 34 and the plunger 56 to return to their correct positions before feeding restarts.

It will be appreciated that during the entire downward movement of the objects the lower horizontal surface of the plunger is close to or in contact with the array of objects, thus preventing the objects from tipping and becoming disorientated before entering the box.

The machine may readily be adapted to pack a box with a different number of layers. To do this, the cam 42 is replaced with a similar cam which has a different number of high and low points and a replacement clutch drive plate with a similar number of ratchet teeth is fitted. The disc 46 is likewise replaced with one having the different number of stops 45. To facilitate this change, the cam 42 plate is preferably split into two parts, the outer part with the cam surface fastening onto a flanged boss.

It will be appreciated that the machine described above enables high speed packing to be carried out with a low speed machine: the only parts that move at high speed are the former block 34 and flaps 15, resulting in low noise level, a long machine life and a high level of safety in operation.

I claim:

1. A packing machine for objects comprising a pair of pivoted vertically movable flaps which, in one position in use, define a horizontal platform, means for forming on the platform a horizontal array of the objects, a vertically movable plunger which includes a member having a horizontal surface which is operatively associated, in use, with the upper surface of the array objects, means for sensing the formation of a complete array of objects on the platform and thereupon initiating downward movement of the plunger, support means for the flaps carried by the plunger and being movable vertically therewith during its initial downward movement, the support means further including members connected to the flaps operative to cause pivoting of the flaps to a substantially vertical position after the initial downward movement, thereby allowing the array of objects to move past the flaps, the plunger being so arranged that during the movement of the flaps the said horizontal surface moves down close to, or in contact with, the upper surface of the horizontal array.

2. A machine according to claim 1, including a cam which rotates about a horizontal axis and has a cam surface with a series of troughs or crests of progressively varying depths or heights and a cam follower operatively associated with the cam and drivingly connected to the plunger whereby the vertical movement of the plunger is controlled by the cam.

3. A machine according to claim 2, wherein the cam follower is carried by an arm mounted for pivotal movement in a vertical plane, the arm being drivingly connected to the plunger.

4. A machine according to claim 2, wherein the cam is mounted on and is rotatable with a shaft, the rotation of which is normally prevented by a pawl and ratchet mechanism and wherein means are provided for withdrawing the pawl to allow the shaft to rotate when a complete array of objects on the platform is sensed.

5. A machine according to claim 4, wherein the pawl is operated by a solenoid controlled by a microswitch which is actuated by the formation of a complete array of objects on the platform and constitutes the said sensing means.

6. A machine according to claim 1, wherein objects are fed onto the platform by a conveyor belt and a driven roller mounted above the downstream end of the belt to contact the upper surface of an object as it leaves the belt, means being provided to interrupt the operation of the conveyor belt and roller during the dropping of the flaps.

7. A machine according to claim 6, wherein the roller is mounted between a pair of arms that pivot about a horizontal axis and which are connected to a solenoid operated lever arm which pivots them to lift the roller on operation of the solenoid.

8. A machine according to claim 6, wherein a drive for the roller and the conveyor are provided from a main motor of the machine via a shaft that drives a clutch, the clutch being operated by a solenoid which is actuated by a microswitch that is switched when a complete array of objects is sensed on the platform.

9. A packing machine for objects comprising a pair of pivoted, vertically movable flaps which, in one position in use, define a horizontal platform, means for forming on the platform a horizontal array of the objects, a vertically movable plunger which includes a member having a horizontal surface which is operatively associated, in use, with the upper surface of the array objects, means for sensing the formation of a complete array of objects on the platform and thereupon initiating downward movement of the plunger, and wherein the flaps are mounted on respective shafts each of which is supported by a respective pair of vertical links from a common vertically movable cross-member connected to the plunger, one of said pair of links being pivoted to the shaft at its lower end and pivoted via a lost motion connection to the cross-member at its upper end and the second of said pair of links being pivoted directly to the cross-member at its upper end and pivoted at its lower end to a connecting link extending from the respective shaft.

10. A machine according to claim 9, wherein a frame part of the machine provides a stop limiting downward movement of the shafts when the cross-member moves vertically down.

11. A machine according to claim 10, wherein the cross-member is connected to the plunger via a lost motion connection such that the cross-member is held stationary during an initial downward movement of the plunger.

12. A machine according to claim 10, wherein the said one of the vertical links is connected to the shaft by an arcuate link which has two arms substantially at right angles to each other.

13. A machine according to claim 12, wherein the arcuate links are connected at their mid-points to horizontally extending shafts at the other end of which are provided support links which are pivotally connected to the other ends of the shaft.

14. A machine for packing objects in successive layers in a container comprising means for dropping successive planar arrays of objects into the container including a plunger arranged to move downwardly with the array as it drops with a lower surface of the plunger in contact with, or in close proximity to, the upper surface of the array, movement of the plunger being controlled by a cam, and wherein the cam is mounted on a shaft and means are provided to cause the cam to make one revolution during each complete cycle of introduction, filling and ejection of a container, the cam periphery having a profile comprising successive high points and low points, a cam follower being operatively associated with the cam periphery and being connected to the plunger to cause movement of the plunger by an amount proportional to the dimension of the high or low point.

15. A machine according to claim 14, in which the cam periphery has a profile comprising successive low points and wherein the peripheral distance between successive low points decreases as the required depth of stroke of the plunger decreases to provide a dwell section on the cam allowing for ejection of a full container and insertion of an empty container.

* * * * *